United States Patent [19]

Ender et al.

[11] 4,445,241

[45] * May 1, 1984

[54] COVER FOR PILLOWS, MATTRESSES AND THE LIKE

[76] Inventors: Sigrid Ender; Ottmar Ender, both of Stuttgarter Str. 125, D-7022 Leinfelden 1, Fed. Rep. of Germany

[ * ] Notice: The portion of the term of this patent subsequent to Nov. 1, 2001 has been disclaimed.

[21] Appl. No.: 129,209

[22] Filed: Mar. 11, 1980

[51] Int. Cl.[3] ..... A47G 9/00; A47C 31/08

[52] U.S. Cl. ..... 5/468; 5/470; 5/490

[58] Field of Search ..... 5/468, 467, 490, 469, 5/501, 470, 471

[56] References Cited

U.S. PATENT DOCUMENTS 3,581,322 6/1971 Marsico ..... 5/470
4,164,797 8/1979 Golembeck ..... 5/470

FOREIGN PATENT DOCUMENTS 1144450 2/1963 Fed. Rep. of Germany ..... 5/468

*Primary Examiner*—Alexander Grosz

[57] ABSTRACT

An air tight and fluid tight cover for padded bodies, mattresses and the like. The cover has a top, a bottom and a plurality of side parts. At least one opening provides ventilation between the interior of the cover and the ambient atmosphere. At least two of the side parts are formed by at least an interior, middle and exterior layer of material. Air passage openings offset with respect to each other are provided in the interior and middle layers of material. At least one filter is disposed between the middle and outer layer of material. A plurality of connecting seams extend partially transversely across the width of the side part from diametrically opposite points of the upper and lower longitudinal edges of the side parts toward a longitudinal center line bisecting the side part. The connecting seams define a plurality of pockets in which the filters are disposed. The connecting seams also define air passages between the individual layers of material for trapping coarse granular particles therein.

12 Claims, 5 Drawing Figures

COVER FOR PILLOWS, MATTRESSES AND THE LIKE

BACKGROUND OF THE INVENTION

The invention relates to a moisture-and air-tight cover for padded bodies such a pillows, and in particular mattresses, wherein the cover is provided with ventilation openings. Such covers generally permit heat and moisture compensation as well as filtration of the air passing from the interior of the cover to the ambient air and vice versa, such filtration filtering out organic and inorganic substances.

There are already know moisture- and air-proof covers for pillow and mattress bodies, in which at least two sides of the cover are formed by means of a plurality of adjacently arranged layers, of which the inner and middle layer has air passages, offset with respect to each other, and wherein between the middle and outer layer there is disposed at least one filtering means.

When untilizing a moisture- and air-tight mattress cover, in particular for hospital beds, it is necessary for sanitary reasons that during the loading and unloading of the mattress a ventilation between the interior of the cover and the ambient atmosphere is made possible. Simultaneously, it is important that the fine dust particles, as well as dust produced by abrasion, etc., does not pass from the mattress interior outwardly and that aerosol particles, bacteria, etc. do not pass from the ambient atmosphere into the interior of the mattress. This is achieved by providing a substantial ventilation between the mattress interior through the cover to the ambient atmosphere and vice versa.

According to West German patent No. 1,144,450, a zig-zag-shaped ventilation airpath through a multi-layered side part of the mattress cover is effected. Such side part of a known mattress cover has a plurality of ventilation openings in the individual layers of the side part, which are offset with respect to each other. It has been found in practice that the dust elimination with such known cover is not adequate and that the ventilation and moisture compensation are too limited.

SUMMARY OF THE INVENTION

It is an object of this invention to improve the afore-described type of mattress cover, so that a substantially higher absorption of the abrasion dust, of the germs present in the air, aerosol particles, bacteria, etc. is effected.

The invention has as a further object to provide a robust, easily manipulated moisture- and air-tight cover for padded bodies, in particular pillows and mattresses, the seams and other sealing means of which do not rip or tear when the mattress is loaded.

This object of the invention is obtained in that the inner, middle and outer layer of the side parts of the cover are connected to each other by means of seams, which are transverse to the longitudinal expansions of the side parts and extend at least along one portion of the width of the side part connecting the side parts to each other. A filter is disposed in a pocket formed by means of two connecting seams in the layers of the side parts. Under the term "seam" there is meant air- and fluid-tight connecting means, which when synthetic materials are used, are better defined as "barriers", that is an uninterrupted connection, for example, a linear connection formed by a welding seam.

The afore-described arrangement has several advantages. First of all, the connection seams, being transversely arranged to the airstream, effect a defined passage for the airstream in which pocket-shaped obstacles can be situated for retention of the more coarse particles. By means of these transverse barriers, which form between them pocket-shaped spaces, there is attained an effective preliminary separation of coarse particles.

By selecting the location of the connecting seams (transverse barriers) between the individual layers it is possible to effect, for example, a meandering air conduction. This effect is created by having the seams extend from one longitudinal edge of the side portions of the cover, to the region spaced a small distance from the opposite longitudinal edge of the side portion of the cover, whereby the beginning of the adjacent seams are at all times situated at opposite longitudinal edges. In this manner, a lengthening of the air passage through the layers of the cover is attained and thereby a better dust separation. In accordance with a preferred embodiment, there can also be provided that the seams define a passage between them, while extending from oppositely positioned longitudinal edges of the side portion. Thereby a better pocket formation is attained in which the dust and the like is deposited.

Whereas with the known mattress covers, each one of the layers is provided with offset air passage openings, it is now been found particularly advantageous that the seam defining the pocket for receiving the filtering means ends at the outer layer, so that in the direction of streaming of the air, the second seam, which forms the pocket, also forms the air-exiting opening by means of an open pocket portion in this seam. This has the advantage that immediately in front of the air-inlet, respectively -outlet opening, a filter for retaining fine fluid droplets, bacteria and the like, is disposed. The separation rate can therefore be substantially increased. The filtering means in this case consists preferably of a fine fiber fleece of synthetic material, in which random fibers are disposed in such density and arrangement, one on top of the other, that even the finest fluid droplets and dust particles are retained in the filtering material. The filtering material can consist of different materials, as long as it has the property, that fine fluid droplets and dust particles are retained in the filter.

Experiments have shown that a very high bacterial elimination (more than 99%) can be attained, when in front of each air-inlet, respectively -output opening, from inside outwardly and vice versa, there is provided a filtering means, so that each air stream passes at all times through at least two filters.

In order to achieve a simple and rapid covering of padded bodies, and in particular pillows and mattresses, there is further provided that at least one gripping handle or strap is arranged on the outer layers of the cover, preferably in the region of the insert opening.

In order for the cover, which may consist of synthetic or other suitable material, not to tear at its seams when loaded, there is further provided that the cover has folds at its corners which are stretchably unfoldable and therefore yieldable.

A bursting-open of the zippers or other suitable fastening means for the mattress cover, such as metal or sliding plastic zippers, can be prevented in that connecting means are provided along the insert opening, such as, for example, connecting straps with the aid of which the zipper halves remain closed under stress thereby additionally connecting the halves to each other.

BRIEF DESCRIPTION OF THE DRAWING

Further features of the invention will be described in connection with the appended drawings, in which several embodiments of the invention are illustrated.

DETAILED DESCRIPTION

Figure 1:
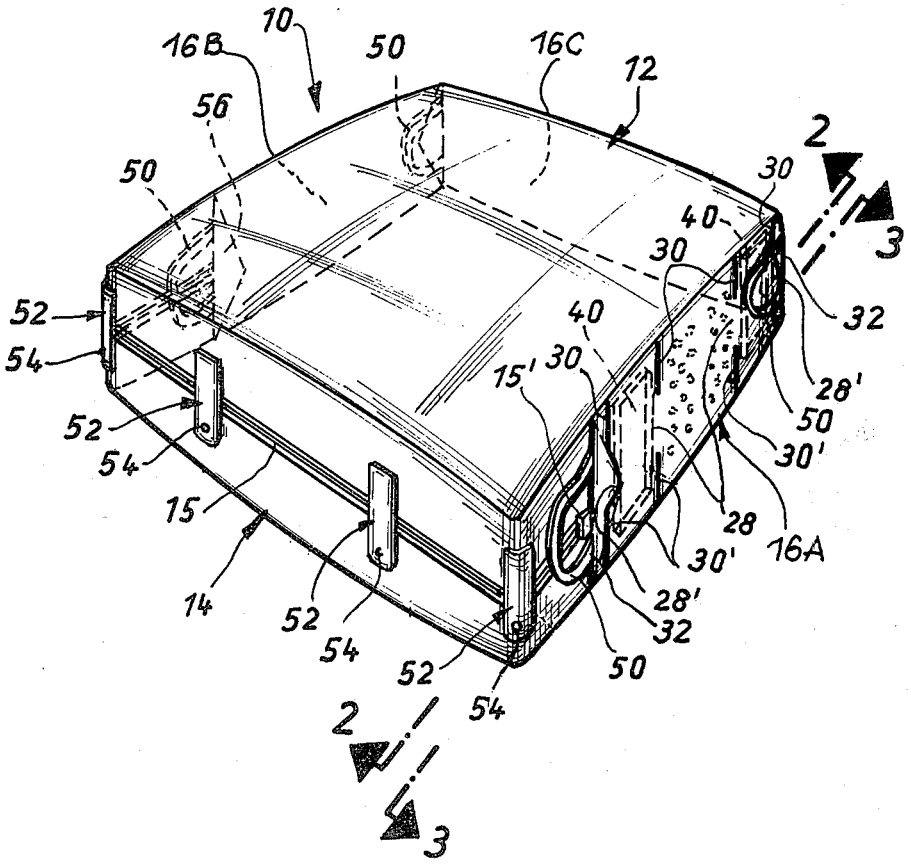
FIG. 1 is a perspective view of a cover in accordance with the invention shown as covering a pillow or mattress body.

As can be noted from FIG. 1, the entire cover is designated with the reference numeral 10. This cover is preferably used in connection with mattresses. It has an upper and lower portion as well as four side portions. A zipper 15 extends partially, centrally along one side portion 16A along the entire adjacent side portion 14 and partially along an adjacent side portion 16B opposite to the first side portion 16A. Preferably the zipper 15 is of the watertight type. There is provided a connecting seam 32 between the zippered side part 14 and the adjacent non-zippered side parts 16A and 16B, said seams 32 being transverse to the longitudinal extend of the zipper 15. Additional transverse seams 32 are provided at two corners of the cover, as is illustrated in FIG. 3. All transverse seams 32 connect all layers of the cover located at the transverse seam 32 to each other. At a small distance from the transverse seams 32 the side parts are formed, by three layers of synthetic sheet material for purposes of ventilation, said three layers consisting of an inner layer 22, a middle layer 23 and an outer layer 24. As can be noted in particular from FIG. 1, the layers are connected to each other by transverse through-seams 30 extending from the top edge downwardly to a point somewhat spaced from the middle of the side part and the transverse through-seams 30', which extend from the lower edge of the side part 16A at points directly opposite to the transverse through-seams 30, also towards. the middle of the side part at a small distance spaced therefrom. The transverse seams 30 and 30' define between them a passage 28 for the passage of air, which will be described hereinafter. There are provided filtering means 40 at least in those locations of the sides of the cover between the outer layer 24 and the inner layer 23, where pockets 22A are defined by the seams 30 and 30'. These filtering means 40 consist, for example, of rectangular fine fiber fleeces. The outer layer 24 ends at a second seam 30' of the side parts 16A and 16B at a small distance from the seams 32. The seams 30, 30', as can be noted in particular from FIGS. 1 and 2, do not extend from one longitudinal edge to the opposite one, but define inlet slits 28' therebetween which remains open and which serves as an air exit and inlet opening and as a conduit to the ambient atmosphere. In the region of this air outlet, respectively inlet slit 28', there is provided a filter insert 40, which is disposed between connecting seams 30 and 30'.

When the mattress is loaded, the air passes from the interior to the laterally arranged air holes 22' of the inner layer 22 as well as the openings 23' disposed in the middle region of the middle layer 23, and finally through the filter inserts 40 through the outlet opening (inlet slit) 28' out to the atmosphere. In this way at least one filtering insert 40 must be passed through by the air stream before the air exits to the ambient atmosphere. The separation of the coarser particles has already been effected between the connecting seams 30 and 30', whereas the fine separation is carried out at the fine fiber fleeces 40. Also fine fluid droplets are retained in the filter 40.

Air streaming in the opposite direction occurs when the mattress is unloaded. Here, it is significant that germs from the ambient air and the like are retained in the filter 40 when entering through the slit 28' into the interior of the mattress. The filter 40 can be replaced in an effortless manner through the slit-shaped openings 28'.

Behind the end of the slit-shaped opening 28', which is sealable by means of the slide zipper 15, as well as in the end region of the other side pocket, in side part 16A there are provided gripping handles or straps 50 made out of synthetic material, which are welded onto the side part 16A. Similarly, such straps 50 are mounted oppositely to the first pair of straps 50 on the side part 16C. This facilitates the mounting of the cover on the mattress and the manipulation of the mattress by service personnel.

In order to avoid that the sealing or slide zipper 15 bursts open when the cover is tightly mounted on the mattress, or when excessive stresses are imparted on the zipper 15 due to forces acting transversely to the longitudinal direction of the zipper 15, there are provided along the longitudinal edges of the zipper transverse connecting straps 52 welded at one of their ends to the side part 14 and extending across the zipper. The straps 52 can be snapped closed by means of a suitable opening in the strap 52 and a mating button 54 also welded onto the synthetic side part 14 of the cover at a location on one side of the zipper which is opposite the location of the strap 52 which is welded onto the side part 14 at the other side of the zipper 15.

Figure 2:
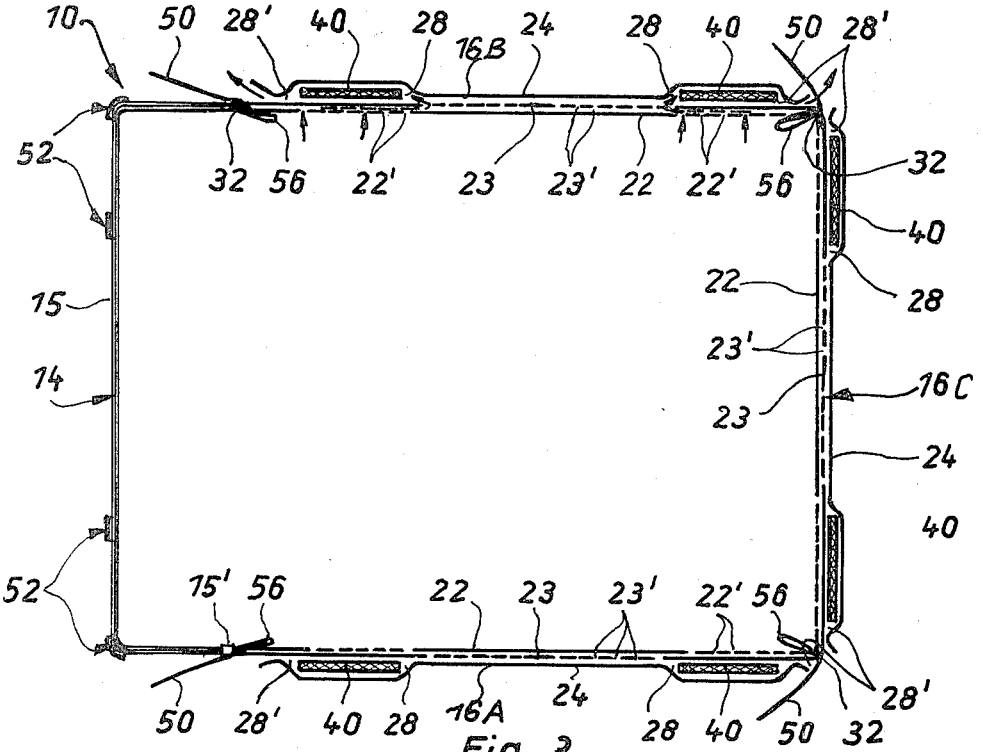
FIG. 2 is a sectional view through the assembly along line 2—2 in FIG. 1.
Figure 3:
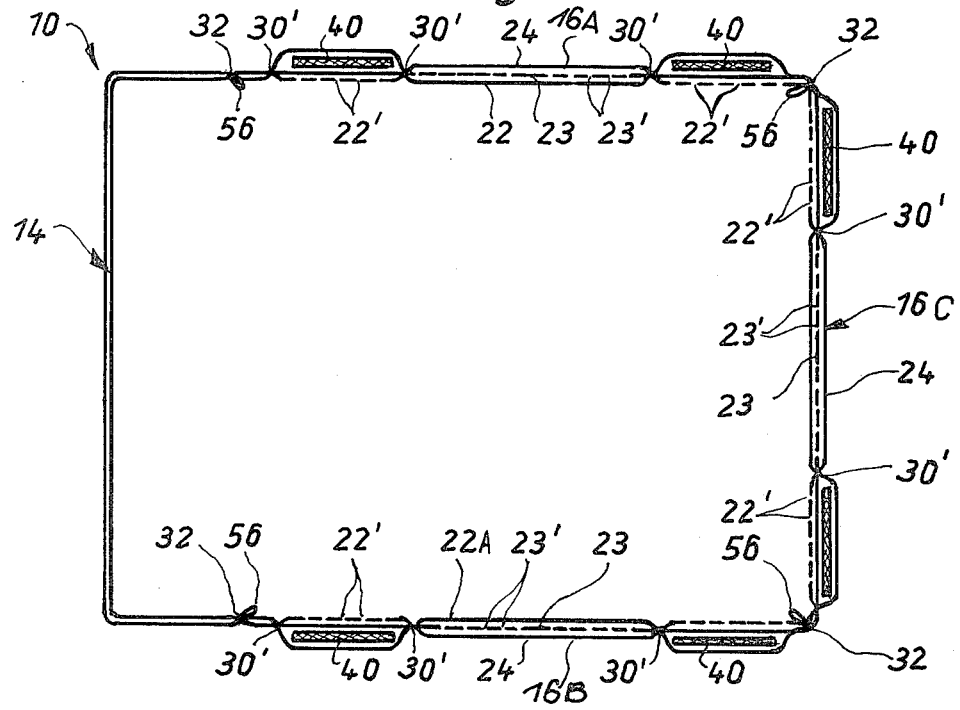
FIG. 3 is a sectional view along line 3—3 of FIG. 1.
Figure 4:
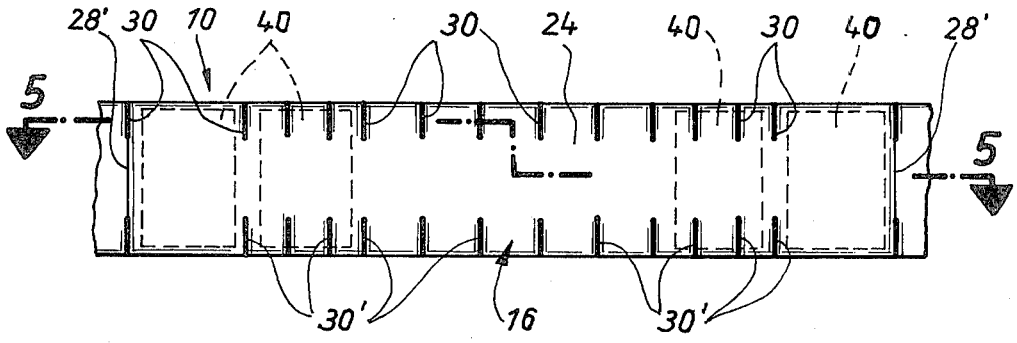
FIG. 4 is a side view of a modified embodiment of the cover of the invention.
Figure 5:
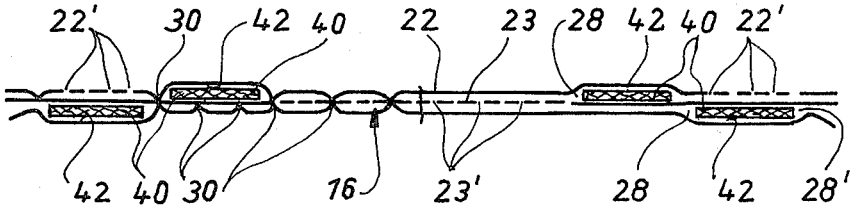
FIG. 5 is a cross-sectional view along line 5—5 of FIG. 4.

As can be noted from FIGS. 1-3, a fold 56 is provided at the corners and at the ends of the zipper, which fold forms a flange and thereby provides a certain tolerance for the material. Upon heavily loading the mattress, there is attained by means of the folds 56 a certain stretchability, which prevents a tearing of the seams of the zipper. In FIGS. 4 and 5, there is disclosed a variation of the afore-described cover, in which there are provided two filters 40 between the individual layers, laterally offset with respect to each other in the region of the air-inlet and -outlet opening (see FIG. 5). In comparison to the embodiment of FIGS. 1-3, there is provided between the inner layer 22 and the middle layer 23 an additional filter 40 in a pocket-type compartment 42 formed by means of the connecting seams 30. Thereby there is obtained that from the interior of the mattress the air can stream outwardly and passes through the filter 40 disposed between the inner and middle layer, thereby a portion of the abrasion dust, which includes germs, is separated, thereafter the air streams through the air exit openings 23' to the next filter 40 disposed between the middle and outer layers 23 and 24 of the mattress cover and then to the ambient atmosphere. It has been determined that thereby an extremely high degree of separation of coarse and fine particles as well as aerosol particles and germs is attained, so that this particular embodiment of the invention is preferable to be used with hospital beds, whereas the mattress cover, in accordance with the embodiment of FIGS. 1–3, is more suitable for use with hotel beds and other pillow bodies.

By means of the stepwise separation of the particles contained in the air stream, that is the preliminary separation at the connecting seams and the fine separation in the filters, a high degree of bacteria and dust removal is attained. Due to the quite large passages for the air streaming, there is furthermore attained a very good ventilation effect, which makes possible an unloading and loading of the mattress in a few seconds, as well as preventing a condensation formation in the mattress itself.

Although the invention is illustrated and described with reference to a plurality of preferred embodiments thereof, it is to be expressly understood that it is in no way limited to the disclosure of such preferred embodiments, but is capable of numerous modifications within the scope of the appended claim.

We claim:

1. An improved air-tight and fluid-tight cover for padded bodies, mattresses and the like, wherein the cover has at least one ventilation opening for regulating the temperature and humidity of the padded body which is enclosed by the cover, and including means for filtering the air circulating between the cover and the ambient atmosphere, said cover having a top part, a bottom part and a plurality of side parts, at least two side parts of said plurality of side parts being formed by means of a plurality of contiguous layers of material, comprising at least one inner, one outer and one middle layer, the inner and middle layer of said parts having air passage openings, which are offset with respect to each other, and at least one filter means being disposed between the middle and outer layers of said side parts, the improvement comprising in combination said inner, middle and outer layers of material being connected to each other by means of a plurality of first connecting seams extending substantially transversely to the longitudinal extents of said side parts across a portion of their widths, at least two contiguous first connecting seams defining at least one pocket therebetween, said filter means being disposed in said pocket.

2. The improved air-tight and fluid-tight cover as set forth in claim 1, wherein each side part has an upper and lower longitudinal edge, wherein said first connecting seams form pairs of first connecting seams extending from diametrically opposite points of said longitudinal edges to points slightly spaced from the center line longitudinally bisecting said side parts.

3. The improved air-tight and fluid-tight cover as set forth in claim 2, wherein each pair of said first pairs of connecting seams forms at least one air passage therebetween.

4. The improved air-tight and fluid-tight cover as set forth in claim 3, wherein said outer layer of material ends at a pair of first connecting seams partly defining said pocket, which pair of first connecting seams is the second pair defining said pocket relative to the air flow direction out of said cover.

5. The improved air-tight and fluid-tight cover as set forth in claim 2, including at least one fastening means extending along the center line longitudinally bisecting a side part to provide an opening when unzipped for the insertion of a padded body into said cover.

6. The improved air-tight and fluid-tight cover as set forth in claim 5, including at least one gripping strap secured to at least one of said side parts having said fastening means.

7. The improved air-tight and fluid-tight cover as set forth in claim 1, wherein the air passage openings in said inner layer are disposed opposite one of said filter means.

8. The improved air-tight and fluid-tight cover as set forth in claim 1, wherein said air passage openings in said middle layer are disposed between said filter means.

9. The improved air-tight and fluid-tight cover as set forth in claim 1, wherein said filter means comprise a fleece consisting of fine, randomly arranged fibers of synthetic material.

10. The cover as set forth in claim 9, wherein said fleece is made of an absorbant material.

11. The improved air-tight and fluid-tight cover as set forth in claim 1, wherein air outlet, respectively inlet openings are disposed in said outer layer, and wherein at least two filter means are arranged between said air passage opening in said inner layer and air outlet, respectively inlet opening in said outer layer, a first one of said two filter means being disposed between said outer and middle layers and a second one of said two filter being disposed between said middle and inner layers.

12. The cover as set forth in claim 1, including folds of material disposed between adjacent side parts of the cover.

* * * * *